United States Patent [19]

Stevenson

[11] 4,236,703

[45] Dec. 2, 1980

[54] CONTROLLED PRESSURE DRAW CLAMP

[76] Inventor: Cleatus G. Stevenson, Box 436, Ashland, Mont. 59003

[21] Appl. No.: 68,433

[22] Filed: Aug. 21, 1979

[51] Int. Cl.[3] ..... B25B 1/20

[52] U.S. Cl. ..... 269/41; 269/53; 269/237

[58] Field of Search ..... 269/41, 42, 237-239, 269/53, 256; 81/347, 362, 363

[56] References Cited

U.S. PATENT DOCUMENTS

| | | | |
|---|---|---|---|
| 371,349 | 10/1887 | Newell | 269/239 |
| 374,264 | 12/1887 | Miller et al. | 269/42 |
| 879,547 | 2/1908 | Holter | 269/53 |
| 3,170,322 | 2/1965 | Cavanaugh | 269/256 |
| 4,021,516 | 5/1977 | Stevenson | 269/41 |

*Primary Examiner*—Robert C. Watson

*Attorney, Agent, or Firm*—Clarence A. O'Brien; Harvey B. Jacobson

[57] ABSTRACT

A guide body having angularly related support surfaces applied to substantially parallel surfaces of a workpiece, supports a pair of pressure distributing jaw elements connected by pin and slot connectors to a handle operated actuating linkage. A plurality of work engaging pins projecting from the pressure pads associated with the jaw elements resist slidable displacement thereof along the work surface as normal clamping pressure is exerted through the pads. The pads are angularly adjusted to the work surfaces to relieve high concentrations of clamping pressure.

11 Claims, 4 Drawing Figures

CONTROLLED PRESSURE DRAW CLAMP

BACKGROUND OF THE INVENTION

This invention relates generally to a draw clamp for holding angularly related portions of a workpiece in abutment with each other and more particularly is an improvement over clamps of the type disclosed in my prior U.S. Pat. No. 4,021,516, issued May 3, 1977.

Clamps of the aforementioned type are limited in clamp holding power by the material of the workpiece, such as wood, which is often deformed and large holes created therein by wood piercing jaw elements. Such clamps are also subject to breakage by concentrations of high clamping pressure.

It is therefore an important object of the present invention to provide a clamp device having a higher and safer clamp holding power as compared to prior art clamp devices of the same type. A further object is to provide such a clamp device which will be effective for clamping workpieces made of materials other than wood and will avoid deep puncturing of the material surfaces by the jaw elements.

SUMMARY OF THE INVENTION

In accordance with the present invention, the work engaging jaw elements of a clamp device of the aforementioned type include pressure distributing pads from which work surface engaging pins project over a wide area. Shank portions of the jaw elements project from the pads through guide slots in the angularly related support surfaces of the guide body to which the handle operated actuating linkages are connected. Pin and slot connectors interconnect the jaw elements with the actuating linkages for accommodating angular adjustment of the pads to the work surfaces thereby relieving excessive pressure concentrations. The pressure pads are displaced by limited amounts from positions seated on the support surfaces of the guide body to adjusted clamping positions in which a high holding power is established corresponding to displacement of the operating handle to a locked clamping position. The shallow punctures in the workpiece made by the pins projecting from the pressure pads may be readily removed by sanding.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWING FIGURES

DETAILED DESCRIPTION OF PREFERRED EMBODIMENT

Figure 1:
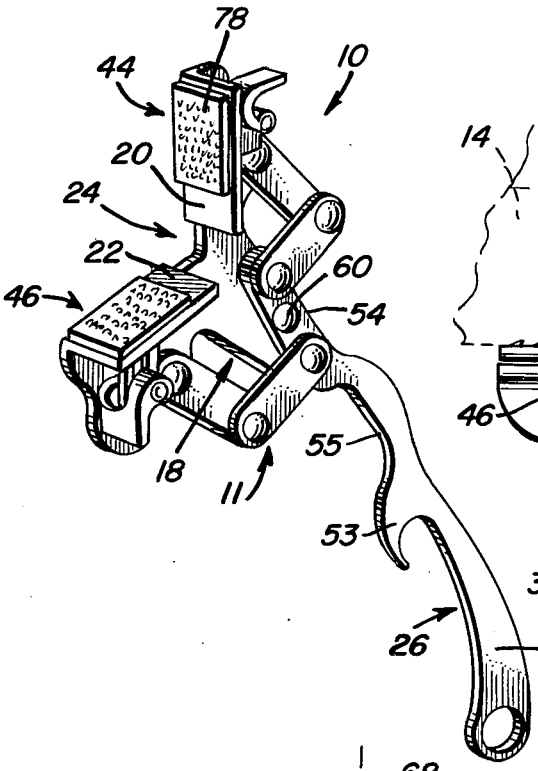
FIG. 1 is a perspective view showing a clamp device constructed in accordance with the present invention, in a released condition.

Referring now to the drawings in detail, FIG. 1 illustrates a clamp device generally referred to by reference numeral 10 constructed in accordance with the present invention. The clamp device is of the type which includes a guide body generally denoted by reference numeral 18 to which a clamp actuating linkage arrangement 11 is connected and from which a pair of angularly related jaw elements 44 and 46 project. A clamping force is applied to each of the jaw elements by the user through an operating handle 26 associated with the actuating linkage 11. The clamp device is shown in FIG. 1, in a released condition.

Figure 2:
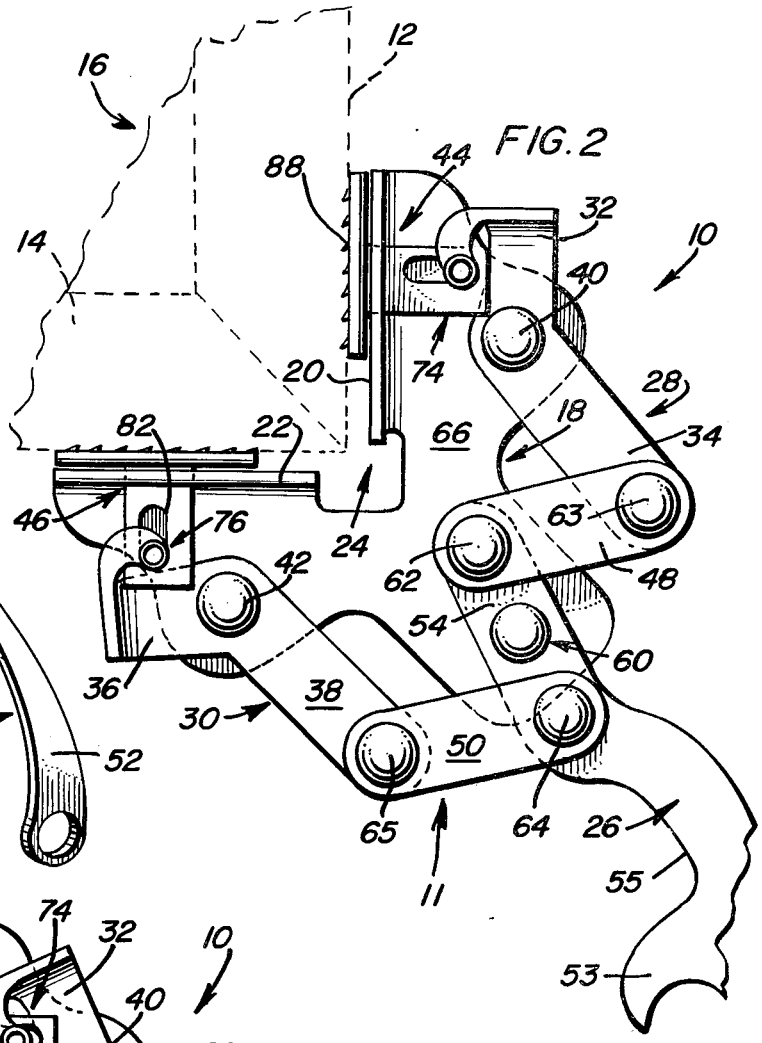
FIG. 2 is a side elevation view of the clamp device shown in FIG. 1, applied to the corner of a typical picture frame workpiece.
Figure 3:
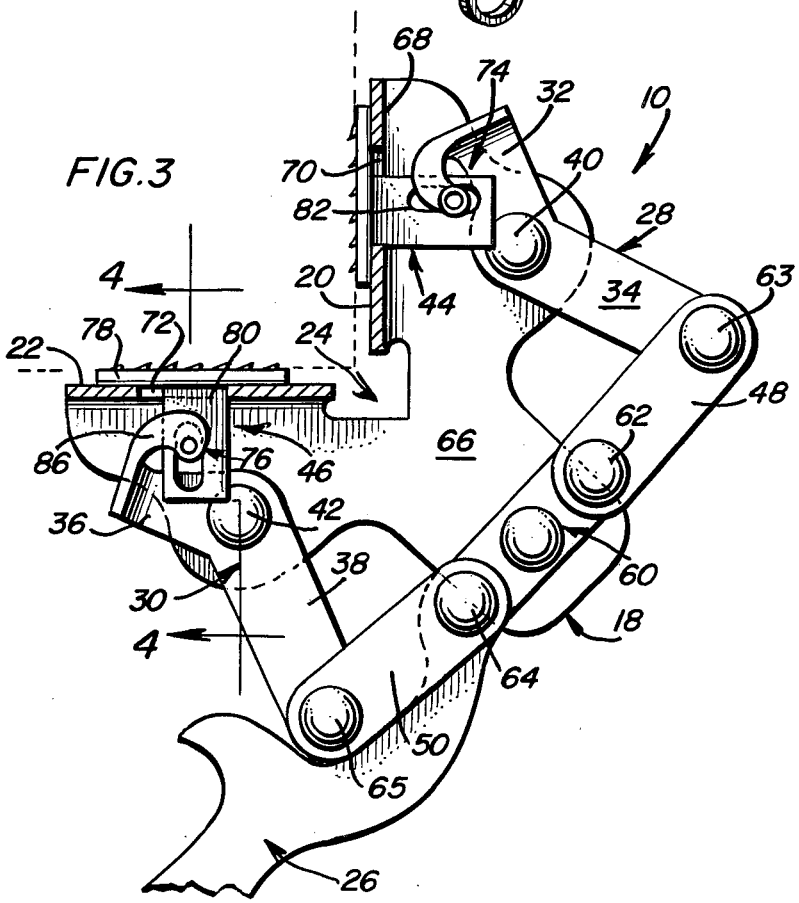
FIG. 3 is a side elevation view similar to FIG. 2, but showing the clamp device in a clamping condition.

FIG. 2 also shows the clamp device 10 in a released condition applied to a workpiece 16 in the form of a picture frame. The guide body 18 presents a pair of planar support surfaces 20 and 22 at right angles to each other to form a cradle 24 for supporting the abutting frame members 12 and 14 at a right angle corner of the picture frame. The jaw elements 44 and 46 project from the support surfaces 20 and 22 to engage the frame members as shown. The operating handle 26 is connected to the body 18 by a pivot 60 and is angularly displaced in a clockwise direction as viewed in FIG. 2 to a locked clamping position as shown in FIG. 3.

The actuating linkage 11 is of the over-center, toggle type, and includes jaw levers 28 and 30 respectively connected to the guide body by pivots 40 and 42. The levers are interconnected with the jaw elements 44 and 46 through relatively short lever arms 32 and 36 as compared to the longer lever arms 34 and 38 respectively connected by links 48 and 50 to the operating handle 26 on either side of its pivot connection 60 on the guide body. Pivot pin connections 62 and 63 interconnect opposite ends of link 48 with the handle 26 and the lever 28 while pivot connections 64 and 65 interconnect opposite ends of link 50 with the handle and lever 30.

The operating handle 26 includes a curved hand grip portion 52 remote from the guide body and a straight connecting portion 54 to which the pivots 60, 62 and 64 are connected. An intermediate projection 53 on the handle limits slidable movement of the user's hand along the handle. A recess 55 between the projection 53 and portion 54 of the handle is adapted to abut the end of link 30 and thereby limit movement of the handle to an over-center locking position as shown in FIG. 3. In this locking position, the jaw elements 44 and 46 firmly grip the corner of the workpiece 16 between the planar support surfaces 20 and 22 of the guide body 18.

Figure 4:
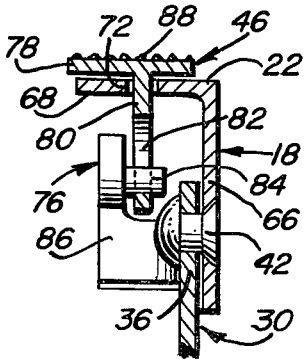
FIG. 4 is a partial section view taken substantially through a plane indicated by section line 4—4 in FIG. 3.

The guide body 18 includes a generally planar or plate-like portion 66 through which the pivots 40, 42 and 60 extend along parallel spaced pivot axes perpendicular thereto. The support surfaces 20 and 22 are formed on flanges 68 extending laterally from the plate-like portion 66 as more clearly seen in FIG. 4. Elongated guide slots 70 and 72 are formed in these flanges intersecting the surfaces 20 and 22 to mount the jaw elements 44 and 46 for limited displacement relative to the guide body. The jaw elements are operatively connected to the short lever arms 32 and 36 of the jaw levers 28 and 30 by means of lost motion connectors 74 and 76 in accordance with the present invention.

Each of the jaw elements 44 and 46 and the lost-motion connector 74 or 76 associated therewith are similar in construction and arrangement. Each jaw element includes a planar pressure pad 78 slidably carried on the support surface 20 or 22, and a shank portion 80 extending through a slot 70 or 72 of flange 68 as more clearly seen in FIG. 4. The lost-motion connector associated with each jaw element includes a slot 82 formed in the shank portion 80 and a pin 84 received in the slot. The pin 84 projects from a lateral extension 86 of the short lever arm 32 or 36 straddling the shank portion 80 of the jaw element. By means of the pin and slot connectors 74 and 76, clamping forces are transmitted by the jaw levers 28 and 30 to the jaw elements while permitting the jaw elements to be angularly adjusted on the engaged surfaces of the workpiece. The clamping pressure exerted is applied by the planar pressure pads 78 over a wide area to avoid local concentration of clamping stresses on the workpiece. Also, a plurality of small pin-like projections 88 on the pads 78 are provided for engagement with the workpiece surfaces to resist slidable displacement parallel to the engaged work surfaces.

The clamp device 10 is applied to a workpiece as shown in FIG. 2 with the handle 26 extending generally in bisecting relation to the right angle formed between surfaces 20 and 22 of the guide body 18. In this position of the handle, the jaw levers 28 and 30 and lost-motion connectors 74 and 76 hold the pressure pads 78 of the jaw elements retracted against surfaces 20 and 22 so that the clamp device may be fitted onto a right angle corner of the workpiece as shown. As the handle is pivotally displaced clockwise from the position shown in FIG. 2, force components are transmitted by the actuating linkage 11 with a mechanical advantage tending to displace the pads normal to the engaged surface of the workpiece members 12 and 14 and parallel to such workpiece surfaces toward each other. The normal forces are resisted by the workpiece over the area covered by the pads 78 to produce a higher but distributed clamping pressure and avoid puncture and deformation by a high localized clamping pressure. The pins 88 on the pad resist slidable displacement of the pads parallel to the workpiece surfaces to insure maximum clamping power. Further, because of the pin and slot connections, the pads will be automatically adjusted angularly to the workpiece surfaces within the confines of slots 70 and 72 and thereby relieve any excessive concentration of clamping pressure that may otherwise cause breakage of the clamp device. An unexpectedly high clamp holding power is achieved when the handle 26 reaches its locked, over-center position as shown in FIG. 3.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. In a handle-locking clamp device having a guide body to which an operating handle is pivotally connected, a pair of jaw levers pivotally mounted on the guide body respectively connected by links to the operating handle and a pair of angularly related jaw elements engageable with a workpiece and respectively connected to the jaw levers, the improvement residing in means mounting each of said jaw elements on the guide body for limited displacement, and lost-motion connecting means interconnecting said jaw levers with the jaw elements, respectively, for transmitting clamping forces to the jaw elements, each of said jaw elements having pressure distributing means displaceable relative to said guide body and the jaw lever associated therewith for preventing localized concentration of clamping pressure applied to the workpiece.

2. The improvement as defined in claim 1 wherein said pressure distributing means includes a pressure pad having a planar surface, and a plurality of work engaging pins projecting from said planar surface.

3. The improvement as defined in claim 2 wherein said lost-motion connecting means includes a pin and slot connection through which the clamping force is transmitted to the pressure pad at an automatically adjusted angle.

4. The improvement as defined in claim 3 wherein said mounting means comprises a pair of guide flanges fixed to the guide body on which the pressure pads of the jaw elements are slidable, guide slots being formed in the flanges through which the jaw elements extend perpendicular to said planar surfaces of the pressure pads.

5. The improvement as defined in claim 2 wherein said mounting means comprises a pair of guide flanges fixed to the guide body on which the pressure pads of the jaw elements are slidable, guide slots being formed in the flanges through which the jaw elements extend perpendicular to said planar surfaces of the pressure pads.

6. In a clamp device having a guide body to which an operating handle is pivotally connected, a pair of jaw levers pivotally mounted on the guide body respectively connected by links to the operating handle and a pair of angularly related jaw elements engageable with a workpiece and respectively connected to the jaw levers, the improvement residing in lost-motion connecting means interconnecting said jaw levers with the jaw elements, respectively, for transmitting clamping force to the jaw elements, each of said jaw elements having a pressure pad engageable with a surface of the workpiece in response to the clamping force applied thereto, and means mounting the pressure pad on the guide body for limited displacement following engagement with the workpiece under said clamping force.

7. The improvement as defined in claim 6 including a plurality of work engaging pins projecting from the pressure pad.

8. The improvement as defined in claim 7 wherein said mounting means comprises a pair of guide flanges fixed to the guide body on which the pressure pads of the jaw elements are slidable.

9. The improvement as defined in claim 6 wherein said mounting means comprises a pair of guide flanges fixed to the guide body on which the pressure pads of the jaw elements are slidable.

10. In a clamp device having a guide body adapted to be positioned in operative relation to a workpiece, a pair of jaw elements carried by the guide body, an operating handle connected to the guide body and actuating means interconnecting the handle with the jaw elements for locking the jaw elements in clamped positions on the workpiece, the improvement residing in pressure distributing means mounted on the guide body and connected to the jaw elements for engagement with the workpiece under a clamping force applied from the handle through the actuating means, and lost motion means for transferring the clamping force to the pressure distributing means at an adjusted angle establishing said clamped positions of the jaw elements.

11. In a clamp device having a guide body to which an operating handle is operatively connected, a pair of jaw elements, and actuating means operatively connected to the operating handle for displacement of the jaw elements under angularly related clamping forces, the improvement residing in lost motion means connected to the actuating means for transmitting said clamping forces to the jaw elements, respectively, and pressure distributing means mounted on the jaw elements for angular adjustment by said clamping forces in response to initial engagement with the workpiece to effectively clamp the workpiece.

* * * * *